US011288922B2

(12) United States Patent
Higgins et al.

(10) Patent No.: US 11,288,922 B2
(45) Date of Patent: Mar. 29, 2022

(54) CREDIT CARD GAMBLER POINTS PROGRAM WITH MANUAL OR AUTOMATED ENTRIES OR WAGERS

(71) Applicant: IGT, Las Vegas, NV (US)

(72) Inventors: Kevin Higgins, Reno, NV (US); Jeffery Shepherd, Reno, NV (US); Dwayne A. Davis, Reno, NV (US)

(73) Assignee: IGT, Las Vegas, NV (US)

( * ) Notice: Subject to any disclaimer, the term of this patent is extended or adjusted under 35 U.S.C. 154(b) by 144 days.

(21) Appl. No.: 16/593,846

(22) Filed: Oct. 4, 2019

(65) Prior Publication Data

US 2021/0104119 A1 Apr. 8, 2021

(51) Int. Cl.
*G07F 17/32* (2006.01)

(52) U.S. Cl.
CPC ..... *G07F 17/3244* (2013.01); *G07F 17/3223* (2013.01)

(58) Field of Classification Search
CPC ..... G07F 17/3223; G07F 17/3225; G07F 17/3244; G07F 17/3288
See application file for complete search history.

(56) References Cited

U.S. PATENT DOCUMENTS 7,168,616 B2 1/2007 Carnation
7,316,614 B2 * 1/2008 Dietz ..... G07F 17/32 463/25
7,448,537 B2 11/2008 Carnation
7,780,522 B2 * 8/2010 Lutnick ..... G07F 17/3253 463/25
7,980,948 B2 * 7/2011 Rowe ..... G07F 17/32 463/29
10,347,081 B2 * 7/2019 Walker ..... G07F 17/3272
10,607,445 B2 * 3/2020 Higgins ..... G06Q 30/0226
10,643,426 B2 * 5/2020 Higgins ..... G06Q 20/3674
10,706,667 B1 * 7/2020 Shepherd ..... G07F 17/3223
10,728,698 B2 * 7/2020 Phillips ..... G08B 21/0269
10,937,271 B2 * 3/2021 Malek ..... G07F 17/3258
10,950,081 B2 * 3/2021 Baker ..... G07F 17/3276
11,087,587 B2 * 8/2021 Palmisano ..... G07F 17/3267
2001/0050311 A1 * 12/2001 Avellino ..... G07F 17/32 235/380
2002/0094869 A1 * 7/2002 Harkham ..... G07F 17/32 463/42

(Continued)

*Primary Examiner* — William H McCulloch, Jr.
(74) *Attorney, Agent, or Firm* — Sheridan Ross P.C.

(57) ABSTRACT

The present disclosure relates generally to managing rewards associated with use of a credit account and comprising receiving an electronic message indicating use of a credit account to make a purchase and indicating a value of the purchase. An accumulated rewards value comprising a portion available for wagering and a portion unavailable for wagering can be updated by incrementing the portion unavailable for wagering based on the value of the purchase. The portion unavailable for wagering can be decremented and the portion available for wagering can be incremented based on the value of the purchase. An electronic message indicating an amount of a wager placed by the user on a gaming event can be provided and the portion of the accumulated rewards value available for wagering can be decremented based on the amount of the wager.

20 Claims, 6 Drawing Sheets

(56) References Cited

U.S. PATENT DOCUMENTS

| | | | | |
|---|---|---|---|---|
| 2005/0021457 | A1* | 1/2005 | Johnson | G06Q 20/10 705/39 |
| 2008/0146344 | A1* | 6/2008 | Rowe | G07F 17/3288 463/42 |
| 2008/0207296 | A1* | 8/2008 | Lutnick | G07F 17/3272 463/16 |
| 2009/0325686 | A1* | 12/2009 | Davis | G07F 17/32 463/25 |
| 2013/0203485 | A1* | 8/2013 | Walker | G07F 17/3272 463/25 |
| 2018/0089961 | A1* | 3/2018 | Filipour, Jr. | G07F 17/3274 |
| 2019/0102985 | A1* | 4/2019 | Higgins | G07F 17/3225 |
| 2019/0147703 | A1* | 5/2019 | Malek | G07F 17/3251 463/20 |
| 2019/0188955 | A1* | 6/2019 | Min | G07F 17/3255 |
| 2019/0304249 | A1* | 10/2019 | Malek | G07F 17/3223 |
| 2020/0043293 | A1* | 2/2020 | Nelson | G07F 17/3267 |
| 2020/0265676 | A1* | 8/2020 | Higgins | G07F 17/3248 |
| 2020/0265685 | A1* | 8/2020 | Nelson | G07F 17/3244 |
| 2020/0372755 | A1* | 11/2020 | Shepherd | G06Q 20/36 |
| 2021/0090389 | A1* | 3/2021 | Shepherd | G06Q 20/20 |
| 2021/0090391 | A1* | 3/2021 | Shepherd | G07F 17/3248 |
| 2021/0104119 | A1* | 4/2021 | Higgins | G07F 17/323 |
| 2021/0104123 | A1* | 4/2021 | Shepherd | G07F 17/3255 |
| 2021/0150851 | A1* | 5/2021 | Lutnick | G07F 17/3223 |

* cited by examiner

CREDIT CARD GAMBLER POINTS PROGRAM WITH MANUAL OR AUTOMATED ENTRIES OR WAGERS

BACKGROUND

Embodiments of the present disclosure relate generally to managing rewards associated with the use of a credit account and more particularly to managing rewards available for use to manually or automatically place wagers on a gaming event.

Today, most consumers are members of a credit card rewards program. Consumers typically earn rewards of some form that accumulate at a percentage of the amount spent using their credit card. For example, a consumer may earn 1% cashback on all retail purchases. Alternatively, a consumer may earn points that can be redeemed for a free plane ticket, or other goods, once a certain threshold of points is reached. The problem with many of these programs is that the rewards are proportional to the amount the consumer spends. That is, they do not provide a chance for the consumer to earn back more than the fixed percentage of charges made on the credit account. Some of these programs credit the rewards at the time of purchase. This creates a chance for the consumer to obtain rewards on purchases or other uses of the credit account that are later returned or reversed by disputing the transaction. Hence, there is a need in the art for improved methods and systems for managing rewards associated with the use of a credit account.

BRIEF SUMMARY

In certain embodiments, the present disclosure relates to a rewards management system. The system can comprise a network communication interface, a processor coupled with the network communication interface, and a memory coupled with and readable by the processor. The processor can store therein a set of instructions which, when executed by the processor, causes the processor to receive, from a banking system through the network communication interface, an electronic message indicating use of a credit account to make a purchase. The electronic message can indicate a value of the purchase. The instructions can cause the processor to update an accumulated rewards value stored in an electronic record associated with a user, the user also associated with the credit account. The accumulated rewards value stored in the electronic record associated with the user can comprise a portion available for wagering and a portion unavailable for wagering. The portion unavailable for wagering can be incremented based on the value of the purchase. The instructions can further cause the processor to decrement the portion unavailable for wagering based on the value of the purchase and increment the portion available for wagering based on the value of the purchase. The instructions can cause the processor to decrement the portion of the accumulated rewards value available for wagering based on the amount of the wager.

According to another embodiment, a gaming system can comprise a network communication interface, a processor coupled with the network communication interface, and a memory coupled with and readable by the processor. The memory can store therein a set of instructions which, when executed by the processor, causes the processor to receive, from a rewards management system through the network communication interface, an electronic message indicating an amount of a wager placed by a user on the gaming event. The amount of the wager can be defined in an intermediate currency accumulated by the rewards management system based on a purchase made using a credit account of the user and made available for wagering by the rewards management system after passage of a predetermined amount of time from the purchase. The instructions can cause the processor to determine a monetary amount for the wager based on the amount of the wager defined in the intermediate currency and apply the determined monetary amount as wager on an outcome of the gaming event.

According to yet another embodiment, a method for managing rewards associated with use of a credit account can comprise receiving, by a rewards management system, an electronic message indicating use of a credit account to make a purchase. The electronic message can indicate a value of the purchase. An accumulated rewards value stored in an electronic record associated with a user, the user also associated with the credit account, can be updated. The accumulated rewards value stored in the electronic record associated with the user can comprise a portion available for wagering and a portion unavailable for wagering. The portion unavailable for wagering can be incremented based on the value of the purchase. The accumulated rewards value stored in the electronic record associated with the user can comprise an intermediate currency and updating the accumulated rewards value stored in the electronic record based on a predefined ratio between the value of the purchase and the intermediate currency. After passage of a predetermined amount of time, the rewards management system can decrement the portion unavailable for wagering based on the value of the purchase and increment the portion available for wagering based on the value of the purchase. The predetermined amount of time can be based on an amount of time during which the purchase can be reversed. An electronic message indicating an amount of a wager placed by the user on a gaming event can be provided by the rewards management system and decrement the portion of the accumulated rewards value available for wagering based on the amount of the wager. The amount of the wager can be based on the portion of the accumulated rewards value available for wagering.

Additional features and advantages are described herein and will be apparent from the following Description and the figures.

DETAILED DESCRIPTION

Embodiments of the present disclosure will be described in connection with managing rewards associated with the use of a credit account. The rewards can be made available for use to manually or automatically place wagers on a gaming event. The rewards can be accumulated at the time the credit card is used, e.g., to pay for a purchased good or service, to take a cash advance, etc. However, use of accumulated rewards that have not actually been earned can occur due to the timing of certain events. Therefore, and according to one embodiment, the rewards are initially not available for use in placing a wager. Instead, the rewards can be credited but held for a period of time. This period of time can correspond to a time during which the charge can be reversed, e.g., by returning the goods or disputing the charges. Once this time has passed, the rewards can be made available for use to place a wager on a gaming event such as a lottery, sweepstake, casino table game, electronic game such as video poker, video keno, etc., a sporting event through a sports book, and others.

Figure 1:
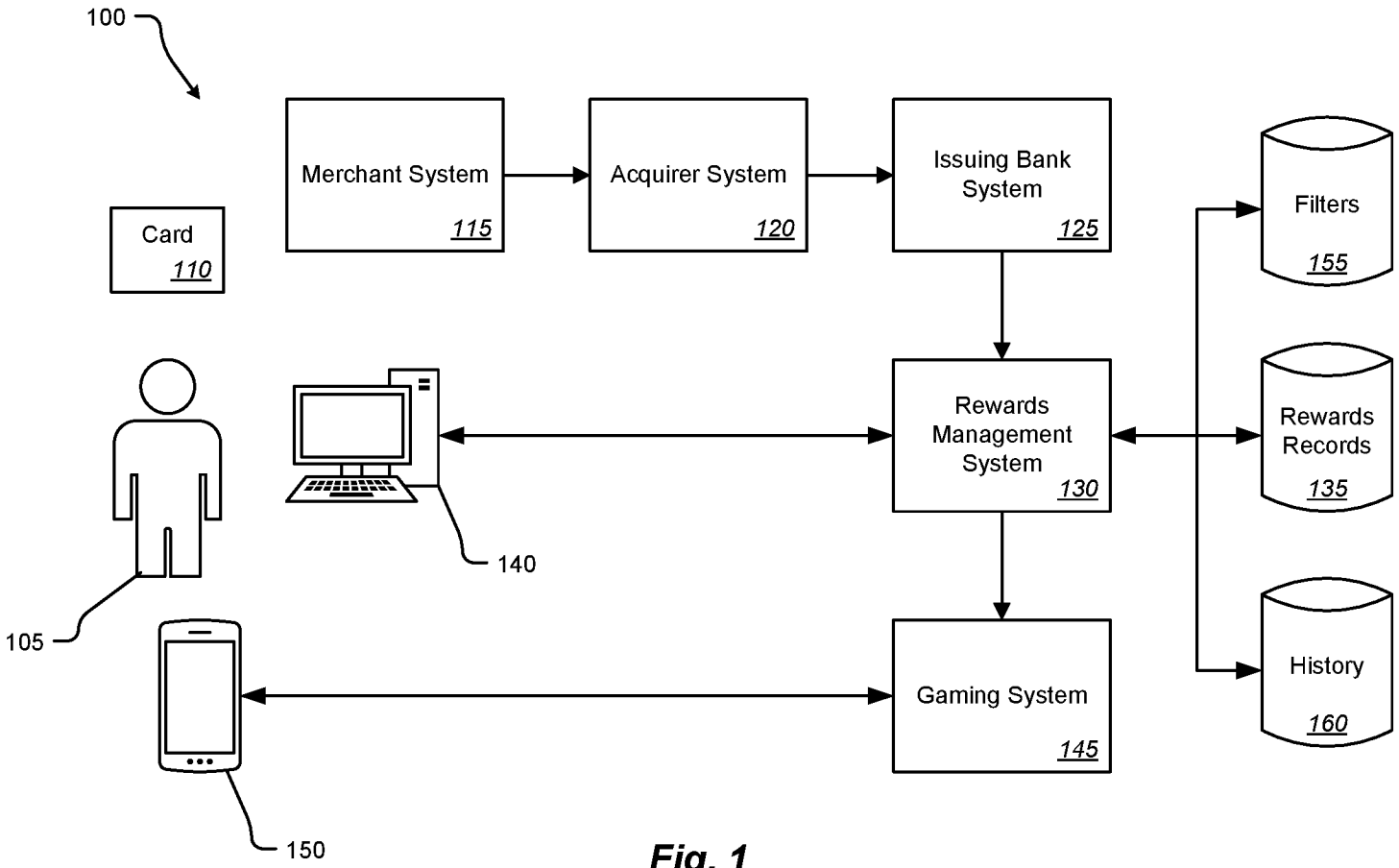
FIG. 1 is a block diagram illustrating an exemplary environment for managing rewards associated with use of a credit account according to one embodiment of the present disclosure.

FIG. 1 is a block diagram illustrating an exemplary environment for managing rewards associated with use of a credit account according to one embodiment of the present disclosure. As illustrated in this example, the environment 100 can include a user 105 associated with a credit account for which a card 110 or other token has been issued. Using this card 110, or number for the credit account, the user 105 can purchase goods or services online or in person, take cash advances, etc. In the case of a purchase, for example, the user 105 can present the card 110 at a point of sale reader in a store or other location or may submit the card number, expiration date, and Card Verification Value (CVV) number online as known in the art. This information, once obtained in this way by a merchant system 115 can then be submitted for payment to the merchant as generally known in the art. Generally speaking, this includes the merchant system 115 submitting the obtained information and information related to the sale, such as purchase price, date and perhaps time of the sale, etc., to an acquirer system 120 of a payment network, such as Visa, for example. The acquirer system 120 in turn provides the information to an issuing bank system 125 for the bank maintaining the credit account associated with the card 110. Once the issuing bank system 125 receives the information, payment can be made to the merchant through various banking systems (not shown here) and as known in the art.

According to one embodiment, a rewards management system 130 can be communicatively coupled with the issuing bank system 125 via the Internet and/or one or more other Wide Area Networks (WANs) and/or Local Area Networks (LANs) (not shown here). When a purchase is made using the credit account, the issuing bank system 125 can provide a notification to the rewards management system 130. This notification can provide information including, but not limited to, information identifying the credit account, the date of the purchase, and the purchase amount.

Generally speaking, the rewards management system 130 can accumulate and manage rewards, maintained in a set of rewards records 135, for the user based on the information about the purchase from the issuing bank system 125. According to one embodiment, the rewards can comprise an intermediate currency that the user is awarded based upon their purchase, e.g., points, tokens, or other indirect measures of value based on the purchase price and which, when earned, can be used to obtain entries in a lottery or drawing, place wagers on a gaming event, etc. This intermediate currency can be earned a sufficient amount of time after a purchase was made, thereby ensuring that the purchase, or set of purchases, used to fund a wager or set of wagers, cannot be reversed. That is, and as noted above, the rewards may initially not be available for use in placing a wager. Instead, the rewards can be credited but held for a period of time. This period of time can correspond to a time during which the charge can be reversed, e.g., by returning the goods or disputing the charges. The exact period of time can be determined based on known policies of the merchant and/or issuing bank and thus may vary depending upon the parties involved. In another case and if such policies are not known, the period of time may be sufficiently long to cover such policies as generally applied in the industry. For example, the period may be defined as 30, 45, or 60 days past the purchase date. In another example, the period may be 30 or 45 days past the end of the billing cycle of the issuing bank or the billing statement on which the purchase appears. Other variations are contemplated and considered to be within the scope of the present disclosure. The rewards records 135, and thus the amount of accumulated rewards available for wagering, can be accessed and viewed by the user 105 using a personal computer or other computing device 140 in communication with the rewards management system 130 via the Internet or other communication network (not shown here).

Regardless of the exact amount of time before rewards are available for wagering, once this time has passed, the rewards can be released and made available for use by the user 105 to place a wager on a gaming event. In one embodiment, some or all of the accumulated and available rewards amount can be manually converted into a wager or drawing entry by a user, e.g., by request made through an application executing on the user's mobile device 150 such a smart phone, tablet, etc. and in communications with a gaming system 145 through one or more wired and/or wireless networks (not shown here). Placing the wager can include, but is not limited to purchasing a draw lottery ticket, purchasing a scratch ticket or instant lottery ticket, placing a wager on a slot game, placing a wager on a keno game, placing a wager on a poker or video poker game, placing a sports wager, placing a wager on a table game, placing a contribution to a mystery bonus, etc.

The wagers or drawings may be presented to the user or credit card owner in various forms. In one embodiment, the user could be presented with a conversion ratio between points and entries or the cost to place a wager or obtain an entry. For example, while a traditional Powerball ticket may cost $2, an online or mobile credit card rewards gambling program may also, or in addition to the traditional street cost, present to the user the cost in the intermediate currency of the rewards program, such as 200 points for a lottery ticket. In one embodiment, the cost of the wager may be proportional to the street cost of the wager (ex: if a point=$0.01, then a $2 wager equals 200 points). In another embodiment, the cost may be discounted or vary from one wager to the next based upon the wagers the casino or lottery wishes to encourage users to place at any given time.

In addition to, or instead of, manually initiated wagers by the user 105, the rewards management system 130 can generate automatic wagers after the points or reward credits are safely earned. In one embodiment, the credit card may be coupled with a game of chance or sweepstakes. For example, the credit card may be marketed or branded as a lottery credit card associated with a particular state or multi-state lottery. A user associated with such a card can have the points, once earned and available for wagering, converted automatically into lottery tickets. Any left-over points that cannot fully fund a lottery ticket can be rolled over to the next week, month, or other period. Additionally, or alternatively, the user 105 could configure through the computing device 140 and rewards management system 130, an automatic wager when the qualities of the bet match certain pre-configured parameters. For example, the user may wish to only automatically purchase lottery tickets using accumulated and available rewards if the lottery jackpot is over a certain, selected monetary value, e.g., $100 million. In some cases, the rewards management system 130 would allow the user 105 to place the wager, either manually requested or automatically generated, if the wager can be wholly funded by accumulated and available rewards. In other cases, wagers could be purchased, in whole or in part, using funds provided by the user, either directly or via the current credit available on the credit account of the user.

As introduced above, the rewards management system 130 can support pre-configuration of automatic bet parameters for one or more gaming events, e.g., through the user's 105 computing device 140 or user's mobile device 150. These parameters, combined with logical operators such as ANDS, ORs, NOTs, etc., can comprise filter criteria 155 maintained by the rewards management system 130. The filters 155 can exist for a particular game or set of games and can be used to determine the bet amount for an automatically generated wager. These filters can include parameters defining one or more of a game type, e.g., draw ticket, instant ticket, slot game, table game, etc., bet type, e.g., minimum bet, maximum bet, game specific bet parameters, such as base bet with or without the multiplier, bet insurance, number of lines, and a wide variety of other parameters directed to different types of gaming events. Various other filters 155 can be configured to place limits on automatic wagers. For example, a rule can be defined for placing automatic wagers up to a limit, either a count limit or rewards amount limit, for a given time period. In another example, a rule can be defined to place limits on consecutive losses of a given automatic wager configuration.

According to one embodiment, when an automatic wager can be generated based on the filters 155, the rewards management system 130 can provide a notification to the user 105 prior to the placement of the wager. In one embodiment, the user 105 can be informed by the rewards management system 130 that a wager can take place in the near or immediate future, thereby giving the consumer enough time to cancel the upcoming automatic wager. In another embodiment, the rewards management system 130 can request approval from the user 105 before making the wager. Such notifications can be made over one or more communication channels, including but not limited to SMS, iMessage, What's App, a web site, a mobile application, etc.

According to one embodiment, the rewards management system 130 can monitor wagers placed by the user 105, either manually requested or approved automatically generated wagers, and maintain a history 160 of these wagers. Using this history 160 the rewards management system 130 can detect trends or patterns over time and can recommend pre-configuration of various automatic bet filter parameters. Additionally, or alternatively, the rewards management system 130 could detect, based on the history 160, that the user 105 has not placed a usual or recurring manual wager, e.g., purchase a lottery ticket every Sunday, and can remind user to place the wager. The reminder can comprise a message, such as over the web, SMS, instant message, e-mail, etc., to the user 105 through the user's computing device 140 and/or mobile device 150.

Figure 2:
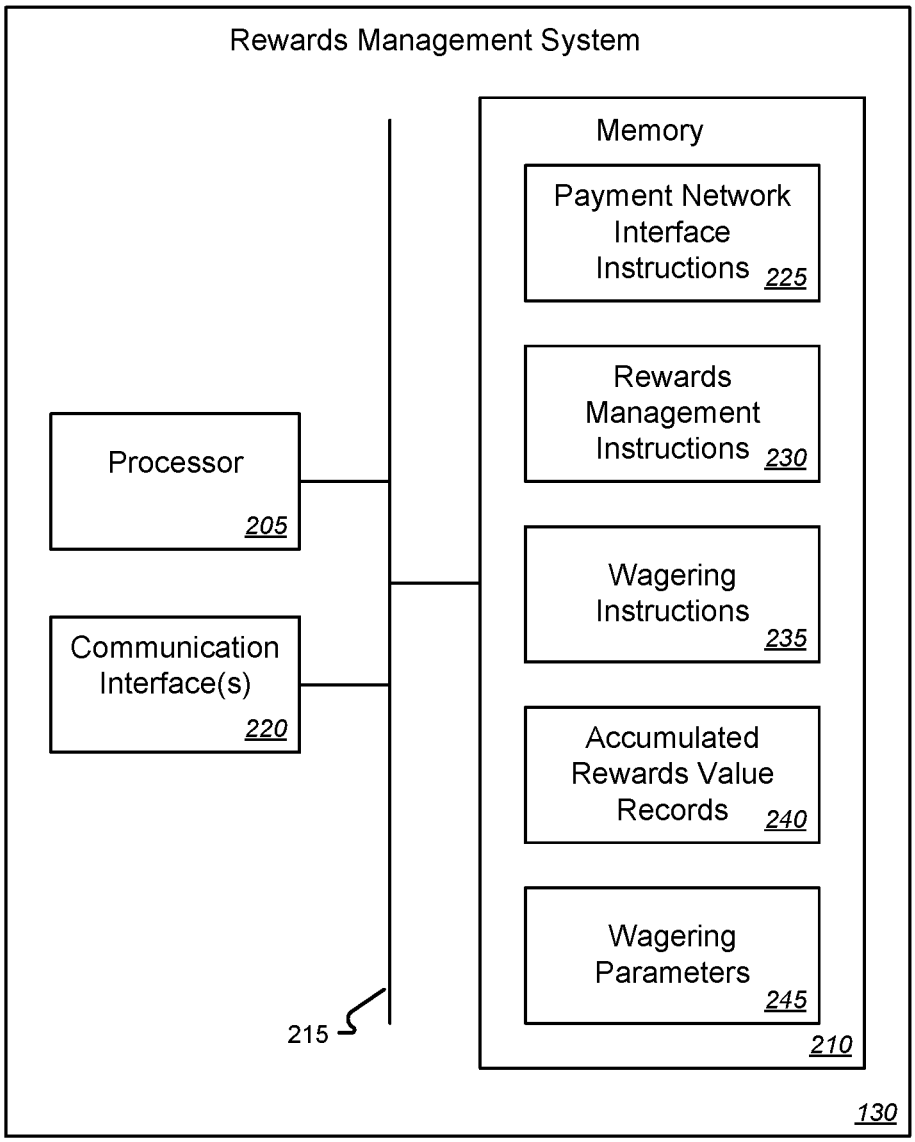
FIG. 2 is a block diagram illustrating additional details of an exemplary rewards management system according to one embodiment of the present disclosure.

FIG. 2 is a block diagram illustrating additional details of an exemplary rewards management system according to one embodiment of the present disclosure. As illustrated in this example, a rewards management system 130 can comprise a processor 205. The processor 205 may correspond to one or many computer processing devices. For instance, the processor 205 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 205 may be provided as a microprocessor, Central Processing Unit (CPU), or plurality of microprocessors that are configured to execute the instructions sets stored in a memory 210. Upon executing the instruction sets stored in memory 210, the processor 205 enables various functions of the rewards management system 130 as described herein.

The memory 210 can be coupled with and readable by the processor 205 via a communications bus 215. The memory 210 may include any type of computer memory device or collection of computer memory devices. Non-limiting examples of memory 210 include Random Access Memory (RAM), Read Only Memory (ROM), flash memory, Electronically-Erasable Programmable ROM (EEPROM), Dynamic RAM (DRAM), etc. The memory 210 may be configured to store the instruction sets depicted in addition to temporarily storing data for the processor 205 to execute various types of routines or functions.

The processor 205 can also be coupled with one or more communication interfaces 220 via the communications bus 215. The communication interfaces 220 can comprise, for example, interfaces for communicating via any of a variety of wired and/or wireless Local Area Networks (LANs), Wide Area Networks (WANs), the Internet, etc. as known in the art.

The memory 210 can store therein sets of instructions which, when executed by the processor 205, cause the processor 205 to manage rewards as described herein. For example, the memory 210 can store a set of payment network interface instructions 225 which, when executed by the processor 205, can cause the processor 205 to receive, from a banking system 125 through the communication interface 220, an electronic message indicating use of a credit account to make a purchase. The electronic message can indicate a value of the purchase, a user associated with the credit account, a date of the purchase, and possibly other information.

The memory 210 can also store a set of rewards management instructions which, when executed by the processor 205, causes the processor 205 to update an accumulated rewards value stored in an electronic record 240 associated with the user also associated with the credit account. The accumulated rewards value records 240 can be stored in the memory 210 of the rewards management system 210 or in an external database or other repository. According to one embodiment, the accumulated rewards value can comprise an intermediate currency, such as points or other indicator of value other than a direct currency value. The rewards management instructions 230 can cause the processor 205 to update the accumulated rewards value based on a predefined ration between the currency value of the purchase and the intermediate currency.

The accumulated rewards value can comprise a portion available for wagering and a portion unavailable for wagering. Initially, the rewards management instructions 230 cause the processor 205 to increment the portion unavailable for wagering based on the value of the purchase as identified in the message received from the banking system 125. The rewards management instructions 230 can further cause the processor 205 to, after passage of a predetermined amount of time, decrement the portion of the accumulated rewards value unavailable for wagering and increment the portion available for wagering based on the value of the purchase. That is, after the predetermined amount of time, the rewards based on the purchase price can be moved from being unavailable to being available for wagering. According to one embodiment, the predetermined amount of time can be based on an amount of time or time period during which the purchase can be reversed by the banking system, e.g., in response to the user returning the purchase, disputing the charge, etc.

The memory 210 can also store a set of wagering instructions 235 which, when executed by the processor 205, causes the processor 205 to provide, to a gaming system 145 through the communication interfaces 220, an electronic message indicating an amount of a wager placed by the user on a gaming event. In other cases, the wagering instructions 235 can cause the processor 205 to receive, from a gaming system 145 through the communication interfaces 220, an electronic message indicating an amount of a wager placed by the user on a gaming event at or through the gaming system 145. The amount of the wager can be based on the portion of the accumulated rewards value available for wagering. The wagering instructions 235 can also cause the processor 205 to decrement the portion of the accumulated rewards value available for wagering based on the amount of the wager.

In some cases, the wagering instructions 235 cause the processor to provide the electronic message indicating the amount of the wager based on a request from the user and received through the communication interfaces 220. For example, the user may request the wager through an app executing on a mobile device 150. In another example, the user may request the wager through a gaming machine, e.g., by swiping or otherwise presenting the card 110 associated with the credit account and electing to use the accumulated value instead of cash or a new credit charge on the account.

In other cases, the wagering instructions 235 can cause the processor 205 to automatically provide the electronic message indicating the amount of the wager based on a set of predefined wagering parameters 245. The predefined wagering parameters 245 can identify the gaming event, the amount of the wager, and conditions for automatically placing the wager. For example, the parameters may define that when a jackpot or prize amount for a particular game reaches a certain level, a wager should be placed using a defined number amount of accumulated value or a defined dollar amount for which a corresponding accumulated value will be used.

When an automatic wager is triggered based on the parameters 245, the user can be notified, e.g., through the user's mobile device 150, through the gaming machine or system being used, or through another device or system. According to one embodiment, the wagering instructions 235 can cause the processor 205 to provide, to a mobile device 150 of the user through the communication interface 220, a notification that a wager will be automatically placed. The notification can provide an option to cancel the wager, e.g., by clicking a link or button, by sending a return message, etc., and provide the electronic message indicating the amount of the wager, and thereby placing the wager, if the user does not select the option to cancel the wager within a predefined period of time. According to another embodiment, the wagering instructions 235 can cause the processor 205 to provide, to a mobile device 150 of the user through the communication interface 220, a notification of an available wager and an option to place the wager. In such cases, the wagering instruction 235 can cause the processor 205 to provide the electronic message indicating the amount of the wager, and thereby place the wager, in response to the user selecting the option to place the wager, e.g., clicking a button or link, sending a reply message, etc.

According to one embodiment, the wagering instructions 235, when executed by the processor 205, can cause the processor 205 to monitor requests from the user identifying a gaming event and an amount of a wager and identify a pattern for wagers by the user based on the monitoring. In such cases, the wagering instructions 235 can further cause the processor 205 to provide, e.g., by a message to the user's mobile device 150, a reminder to the user of a regularly placed wager based on the identified pattern. Additionally, or alternatively, the wagering instructions 235 can cause the processor 205 to provide a suggestion for definition of an automatic wager and/or automatically define parameters for the suggested wager based on the identified pattern.

Figure 3:
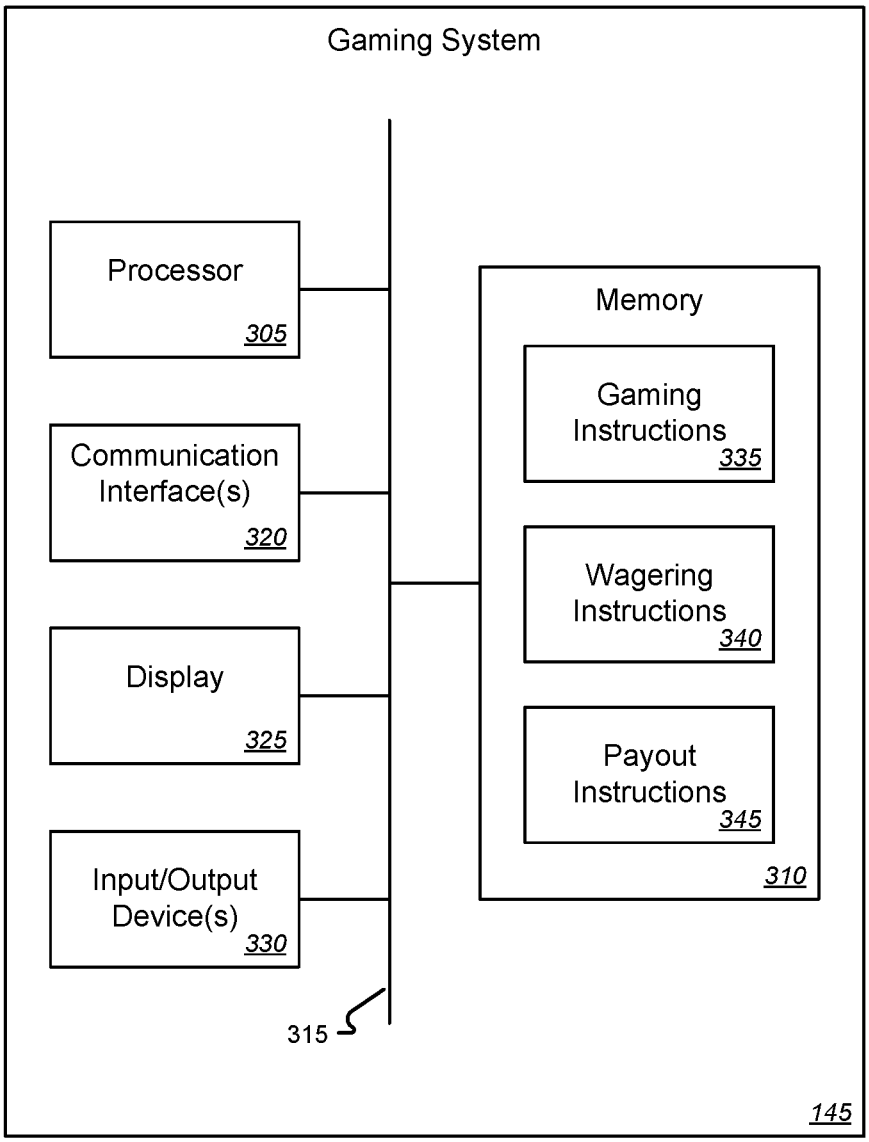
FIG. 3 is a block diagram illustrating additional details of an exemplary gaming system according to one embodiment of the present disclosure.

FIG. 3 is a block diagram illustrating additional details of an exemplary gaming system 145 according to one embodiment of the present disclosure. As illustrated in this example, a gaming system 145 can comprise a processor 305 such as any of the various types of processors described above. A memory 310 can be coupled with and readable by the processor 305 via a communications bus 315. The memory 310 can comprises any one or more of the different types of volatile and/or non-volatile memories described above. The processor 305 can also be coupled with one or more communication interfaces 320, a display 325, and one or more input/output devices 330 via the communications bus 315. The communication interfaces 315 can comprise, for example, interfaces for communicating via any of a variety of wired and/or wireless Local Area Networks (LANs), Wide Area Networks (WANs), the Internet, etc. as known in the art. The display 325 can comprise, for example, a Liquid Crystal Display (LCD), Light Emitting Diode (LED), Organic Light Emitting Diode (OLED), display or other type of display for presenting images and other graphics and can be touch sensitive allowing the user to use the display 325 as an input device as well. The input/output devices 330 can include, but are not limited to, one or more of a speaker, a numeric and/or alphanumeric keypad, a touch pad, one or more buttons or switches, etc.

The memory 310 can store therein sets of instructions which, when executed by the processor 305, cause the processor 305 to interact with the rewards management system 130 to allow the user to place wagers on a gaming event though the gaming system 145 using the accumulated value for the user. More specifically, the memory 310 can store a set of gaming instructions 335 that can, when executed by the processor 305, cause the processor 305 to execute, access, monitor and/or otherwise participate in a gaming event. The gaming event can include, but is not limited to, a lottery, a slot game, a keno game, a poker or video poker game, a sporting event, a casino table game, a mystery bonus, a sweepstakes, etc.

The memory 310 can also store therein a set of wagering instructions 340 which, when executed by the processor 305, cause the processor 305 to receive, from the rewards management system 130 through the communication interface 320, an electronic message indicating an amount of a wager placed by a user on the gaming event. The amount of the wager can be defined in an intermediate currency, e.g., points, credits, tokens, or another non-monetary value, accumulated by the rewards management system based on a purchase made using a credit account of the user and made available for wagering by the rewards management system 130 after passage of a predetermined amount of time from the purchase. The wagering instructions 340 can further cause the processor 305 to determine a monetary amount for the wager based on the amount of the wager defined in the intermediate currency. In some cases, the determined monetary amount can be proportional to a value of the intermediate currency accumulated based on the purchase. In other cases, the amount of the wager in the intermediate currency for the determined monetary value can be discounted relative to a cash wager of a same monetary value, e.g., based on a promotion etc. The wagering instructions 340 can cause the processor 305 to apply the determined monetary amount as wager on an outcome of the gaming event.

The memory 310 can also store a set of payout instructions 345 which can cause the processor 305, upon a completion of the gaming event, make a payout of winnings, if any, based on an outcome of the gaming event. According to one embodiment, the winnings can be paid out as a cash amount or credit to the user. For example, the payout instructions 345 can cause the processor 305 to update an account record for the user such as a casino credit account, a mobile wallet account, an external account, if permissible, etc. In other cases, the payout instructions 345 can cause the processor 305 to dispense, e.g., through a cash or ticket feeder, a cash amount, a redeemable ticket for the cash amount, etc.

Figure 4:
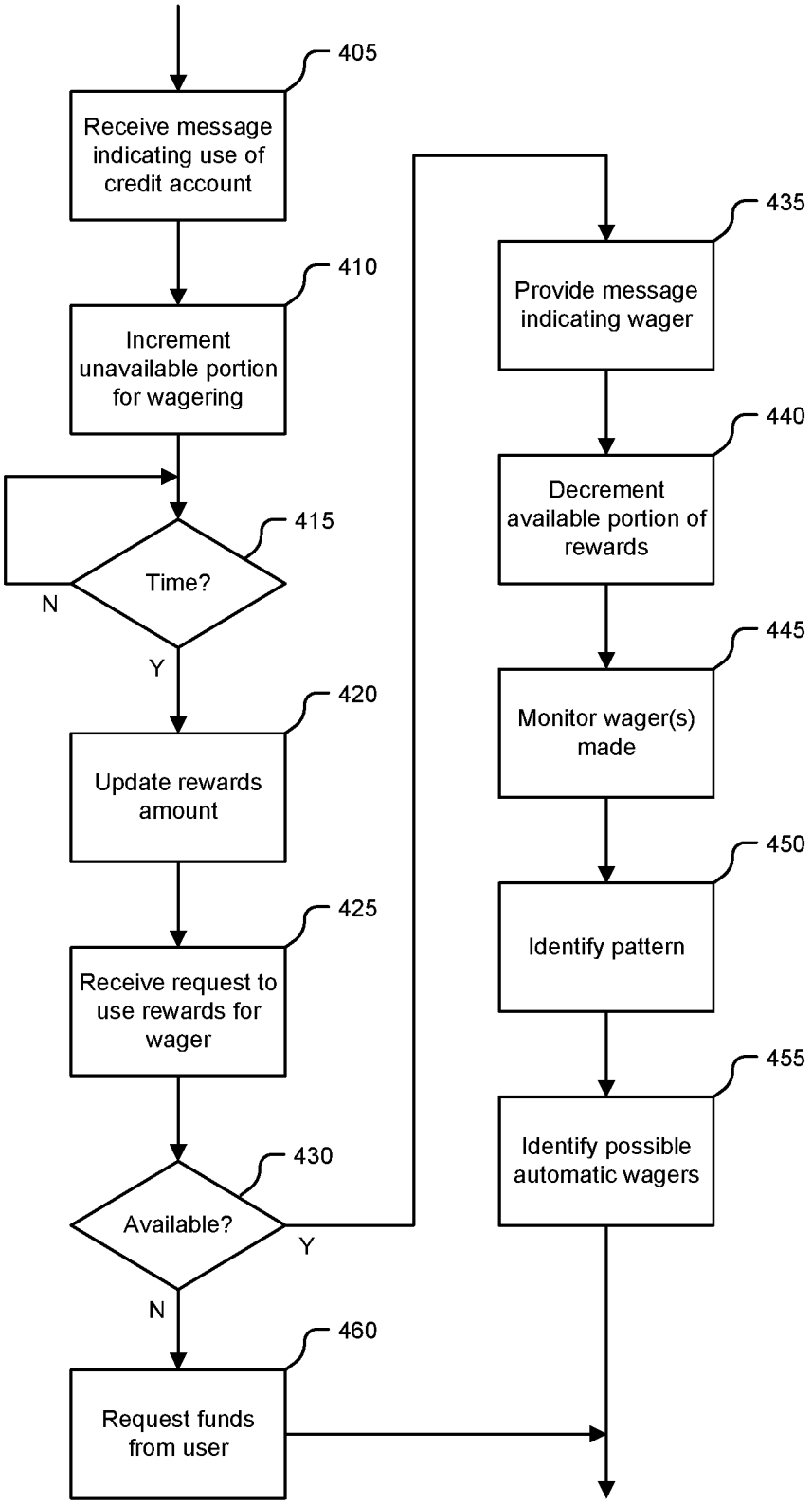
FIG. 4 is a flowchart illustrating an exemplary process for managing rewards associated with use of a credit account according to one embodiment of the present disclosure.

FIG. 4 is a flowchart illustrating an exemplary process for managing rewards associated with use of a credit account according to one embodiment of the present disclosure. As illustrated in this example, managing rewards associated with use of a credit account can comprise receiving 405, from a banking system 125, an electronic message indicating use of a credit account to make a purchase. The electronic message can indicate a value of the purchase, a user associated with the credit account, a date of the purchase, and possibly other information.

An accumulated rewards value stored in an electronic record associated with the user also associated with the credit account can be updated based on information from the received message. According to one embodiment, the accumulated rewards value can comprise an intermediate currency, such as points or other indicator of value other than a direct currency value. According to one embodiment, the accumulated rewards value can comprise a portion available for wagering and a portion unavailable for wagering. In such cases, updating the accumulated rewards value can comprise incrementing 410 the portion unavailable for wagering based on the value of the purchase as identified in the message received from the banking system 125.

A determination 415 can be made as to whether a predetermined amount of time has passed since the purchase or other use of the credit account. The predetermined amount of time can be based on an amount of time or time period during which the purchase can be reversed by the banking system, e.g., in response to the user returning the purchase, disputing the charge, etc. After determining 415 the predetermined amount of time has passed, the rewards amount can be updated 420 by decrementing the portion of the accumulated rewards value unavailable for wagering and incrementing the portion available for wagering based on the value of the purchase. That is, after the predetermined amount of time, the rewards based on the purchase price can be moved from being unavailable to being available for wagering.

At some point in time, a request from the user to use the accumulated rewards value can be received 425. For example, the user may request the wager through an app executing on a mobile device 150. In another example, the user may request the wager through a gaming machine, e.g., by swiping or otherwise presenting the card 110 associated with the credit account and electing to use the accumulated value instead of cash or a new credit charge on the account. A determination 430 can then be made as to whether a sufficient accumulated rewards amount is available to fund the requested wager. In response to determining 430 there is not a sufficient accumulated rewards amount, the wager may be not be made. In other cases, if a rewards amount exists but is not sufficient to fund the total wager, the amount available for wagering can be used to partially fund the wager and the remaining amount to fund the wager can be requested 460 from the user. In such cases, the user may fund the remaining amount of the wager by cash, from another account, etc. In response to determining 430 that a rewards amount sufficient to at least partially fund the wager is available for wagering, a message can be provided 435 to a gaming system 145 indicating an amount of a wager placed by the user on a gaming event and the portion of the accumulated rewards value available for wagering can be decremented 440 based on the amount of the wager.

According to one embodiment, requests from the user identifying a gaming event and an amount of a wager can be monitored 445. Based on the monitoring 445 one or more patterns for wagers by the user can be identified 450. Based on the pattern(s) one or more possible automatic wagers can be determined or identified 455. For example, a message can be provided to the user's mobile device 150 reminding to the user of a regularly placed wager based on an identified pattern. In another example, a suggestion for definition of an automatic wager can be provided to the user and/or parameters for the suggested wager can be automatically defined based on the identified pattern.

Figure 5:
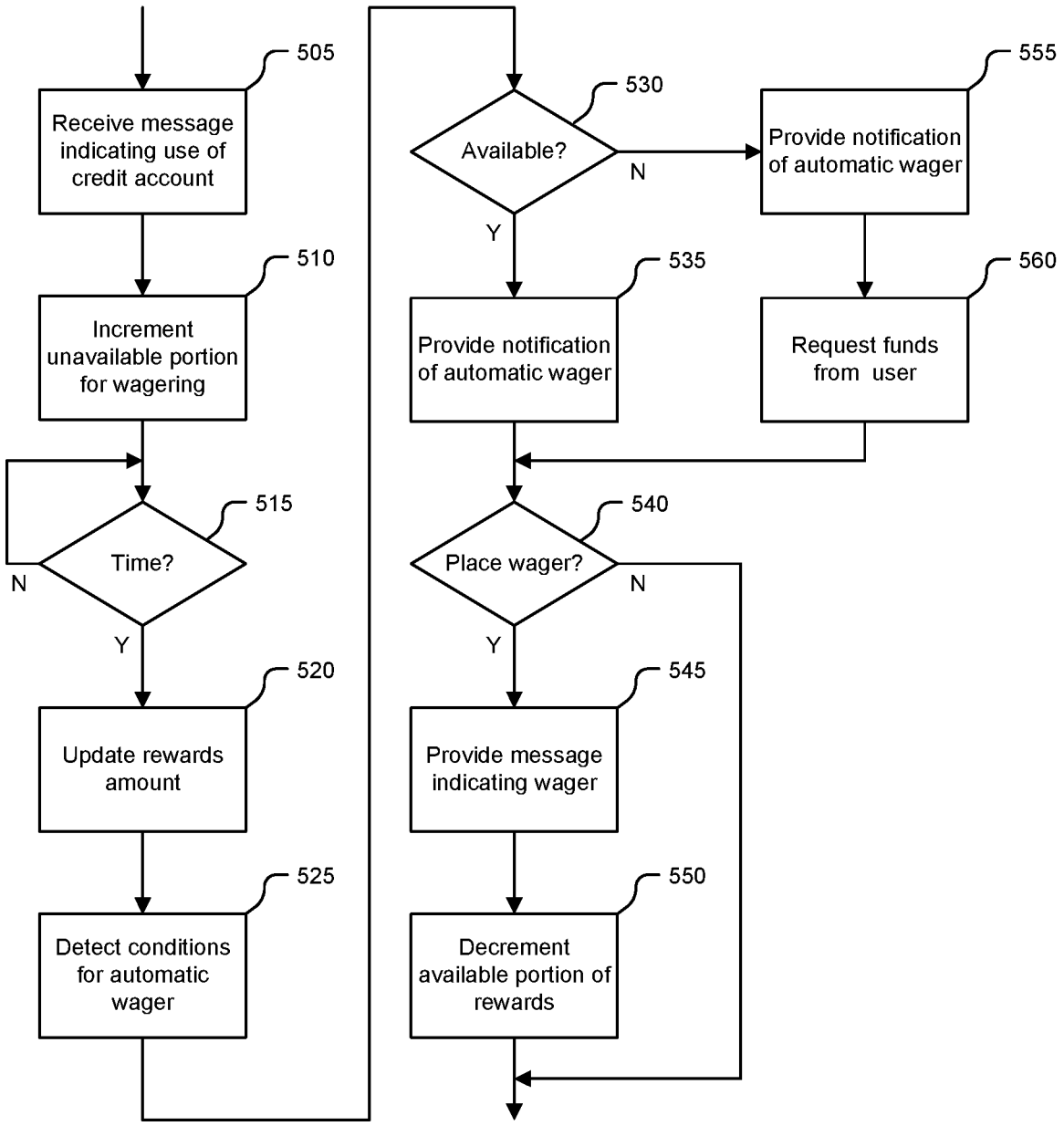
FIG. 5 is a flowchart illustrating an exemplary process for managing rewards associated with use of a credit account according to another embodiment of the present disclosure.

FIG. 5 is a flowchart illustrating an exemplary process for managing rewards associated with use of a credit account according to another embodiment of the present disclosure. As illustrated in this example, managing rewards associated with use of a credit account can comprise receiving 505, from a banking system 125, an electronic message indicating use of a credit account to make a purchase. The electronic message can indicate a value of the purchase, a user associated with the credit account, a date of the purchase, and possibly other information.

An accumulated rewards value stored in an electronic record associated with the user also associated with the credit account can be updated based on information from the received message. According to one embodiment, the accumulated rewards value can comprise an intermediate currency, such as points or other indicator of value other than a direct currency value. According to one embodiment, the accumulated rewards value can comprise a portion available for wagering and a portion unavailable for wagering. In such cases, updating the accumulated rewards value can comprise incrementing 510 the portion unavailable for wagering based on the value of the purchase as identified in the message received from the banking system 125.

A determination 515 can be made as to whether a predetermined amount of time has passed since the purchase or other use of the credit account. The predetermined amount of time can be based on an amount of time or time period during which the purchase can be reversed by the banking system, e.g., in response to the user returning the purchase, disputing the charge, etc. After determining 515 the predetermined amount of time has passed, the rewards amount can be updated 520 by decrementing the portion of the accumulated rewards value unavailable for wagering and incrementing the portion available for wagering based on the value of the purchase. That is, after the predetermined amount of time, the rewards based on the purchase price can be moved from being unavailable to being available for wagering.

At some point in time, an automatic wager can be generated by detecting 525 conditions for the automatic wager. More specifically, predefined parameters can identify a gaming event, an amount of the wager, and/or other conditions for automatically placing the wager. For example, the parameters may define that when a jackpot or prize amount for a particular game reaches a certain level, a wager should be placed using a defined number amount of accumulated value or a defined dollar amount for which a corresponding accumulated value will be used. When such conditions are detected 525, a determination 530 can then be made as to whether a sufficient accumulated rewards amount is available to fund the wager. In response to determining 530 there is not a sufficient accumulated rewards amount, the wager may be not be made. In other cases, and as shown here, if an available rewards amount is not sufficient to fund the total wager, a message can be provided 555 to a gaming system 145 indicating the possible wager and the amount to fully fund the wager can be requested 560 from the user. In such cases, the user may fund the remaining amount of the wager by cash, from another account, etc. In response to determining 530 that a rewards amount sufficient to at least partially fund the wager is available for wagering, a message can be provided 535 to a gaming system 145 indicating an amount of a wager placed by the user on a gaming event.

In response to determining 530 that a rewards amount sufficient to at least partially fund the wager is available for wagering, notification can be provided 535 to the user, e.g., through the user's mobile device 150, through the gaming machine or system being used, or through another device or system. A notification that a wager will be automatically placed can be provided 535 to a mobile device 150 of the user and a determination 540 can be made as to whether to continue with placing the wager. According to one embodiment, determining 540 whether to place the wager can comprise providing in the notification an option to cancel the wager, e.g., by clicking a link or button, and placing the wage, if the user does not select the option to cancel the wager within a predefined period of time. According to one embodiment, determining 540 whether to place the wager can comprise providing in the notification of an available wager and an option to place the wager. In such cases, the wager can be placed in response to the user selecting the option to place the wager, e.g., clicking a button or link, sending a reply message, etc. In either case, in response to determining 540 to place the wager, a message can be provided 545 to a gaming system 145 indicating an amount of a wager placed by the user on a gaming event and the portion of the accumulated rewards value available for wagering can be decremented 550 based on the amount of the wager.

Figure 6:
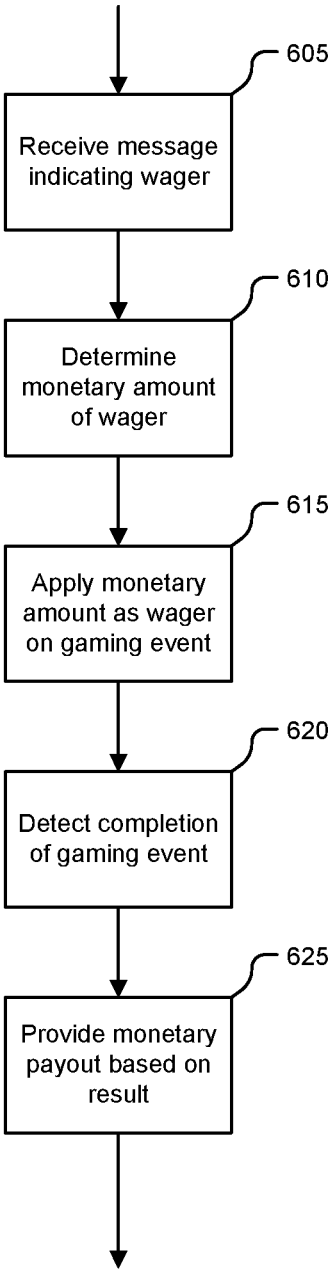
FIG. 6 is a flowchart illustrating an exemplary process for using rewards associated with use of a credit account to place a wager on a gaming event according to one embodiment of the present disclosure.

FIG. 6 is a flowchart illustrating an exemplary process for using rewards associated with use of a credit account to place a wager on a gaming event according to one embodiment of the present disclosure. As illustrated in this example, using rewards to place a wager can comprise receiving 605, from the rewards management system 130, an electronic message indicating an amount of a wager placed by a user on the gaming event. The amount of the wager can be defined in an intermediate currency, e.g., points, credits, tokens, or another non-monetary value, accumulated by the rewards management system based on a purchase made using a credit account of the user and made available for wagering by the rewards management system 130 after passage of a predetermined amount of time from the purchase. A monetary amount for the wager can be determined 610 based on the amount of the wager defined in the intermediate currency. In some cases, the determined 610 monetary amount can be proportional to a value of the intermediate currency accumulated based on the purchase. In other cases, the amount of the wager in the intermediate currency for the determined 610 monetary amount can be discounted relative to a cash wager of a same monetary amount, e.g., based on a promotion etc. The determined 610 monetary amount can then be applied 615 as a wager on an outcome of the gaming event.

Completion of the gaming event can be detected 620 and a payout of winnings, if any, can be provided 625 based on an outcome of the gaming event. According to one embodiment, the winnings can be paid out as a cash amount or credit to the user. For example, an account record for the user such as a casino credit account, a mobile wallet account, or an external account, if permissible, can be updated to reflect payment of the winnings to the user. In other cases, a cash amount, a redeemable ticket for the cash amount, or tokens redeemable for cash can be dispensed through a cash or ticket feeder etc.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store, a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The invention is claimed as follows:

1. A rewards management system comprising:

a network communication interface;

a processor coupled with the network communication interface; and a memory coupled with and readable by the processor and storing therein a set of instructions which, when executed by the processor, causes the processor to:

receive, by the processor, from a banking system through the network communication interface, an electronic message indicating use of a credit account to make a purchase, the electronic message indicating a value of the purchase;

update, by the processor, an accumulated rewards value stored in an electronic record associated with a user, the user also associated with the credit account, wherein the accumulated rewards value stored in the electronic record associated with the user comprises a portion available for wagering and a portion unavailable for wagering, and wherein the portion unavailable for wagering is incremented based on the value of the purchase;

after passage of a predetermined amount of time, decrement, by the processor, the portion unavailable for wagering based on the value of the purchase and increment the portion available for wagering based on the value of the purchase;

determine, by the processor, an amount for an automatic wager for a gaming event;

exchange, by the processor, an electronic message with a gaming system through the network communication interface, the electronic message indicating the determined amount of the automatic wager on the gaming event, wherein the electronic message initiates the automatic wager for the determined amount on the gaming system; and decrement, by the processor, the portion of the accumulated rewards value available for wagering based on the amount of the wager.

2. The rewards management system of claim 1, wherein exchanging the electronic message with the gaming system comprises receiving, from the gaming system through the network communication interface, the electronic message, and wherein the amount of the automatic wager is determined based on the portion of the accumulated rewards value available for wagering.

3. The rewards management system of claim 1, wherein exchanging the electronic message with the gaming system comprises providing, to the gaming system through the network communication interface, the electronic message, and wherein the amount of the automatic wager is determined based on the portion of the accumulated rewards value available for wagering.

4. The rewards management system of claim 3, wherein the instructions cause the processor to provide the electronic message indicating the amount of the wager based on a request from the user.

5. The rewards management system of claim 3, wherein the instructions cause the processor to automatically determine the amount of the automatic wager and provide the electronic message indicating the amount of the automatic wager based on a set of predefined parameters.

6. The rewards management system of claim 5, wherein the predefined parameters identify the gaming event, the amount of the wager, and conditions for automatically placing the wager.

7. The rewards management system of claim 5, wherein the instructions further cause the processor to provide, to a mobile device of the user through the network communication interface, a notification that a wager will be automatically placed, the notification providing an option to cancel the wager and wherein the instruction cause the processor to automatically provide the electronic message indicating the amount of the wager if the user does not select the option to cancel the wager within a predefined period of time.

8. The rewards management system of claim 5, wherein the instructions further cause the processor to provide, to a mobile device of the user through the network communication interface, a notification of an available wager, the notification providing an option to place the wager and wherein the instruction cause the processor to automatically provide the electronic message indicating the amount of the wager in response to the user selecting the option to place the wager.

9. The rewards management system of claim 1, wherein the accumulated rewards value stored in the electronic record associated with the user comprises an intermediate currency and wherein the instructions cause the processor to update the accumulated rewards value stored in the electronic record based on a predefined ratio between the value of the purchase and the intermediate currency.

10. The rewards management system of claim 1, wherein the predetermined amount of time is based on an amount of time during which the purchase can be reversed by the banking system.

11. A gaming system comprising:

a network communication interface;

a processor coupled with the network communication interface; and a memory coupled with and readable by the processor and storing therein a set of instructions which, when executed by the processor, causes the processor to:

receive, by the processor, from a rewards management system through the network communication interface, an electronic message indicating an amount of an automatic wager placed on the gaming event, the amount of the automatic wager defined in an intermediate currency accumulated by the rewards management system based on a purchase made using a credit account of the user and made available for wagering by the rewards management system after passage of a predetermined amount of time from the purchase and wherein the amount of the automatic wager defined in the intermediate currency is determined by the rewards management system based on a set of predefined conditions;

determine, by the processor, a monetary amount for the automatic wager based on the amount of the automatic wager defined in the intermediate currency; and apply, by the processor, the determined monetary amount as a wager on an outcome of the gaming event.

12. The gaming system of claim 11, wherein the determined monetary amount is proportional to a value of the intermediate currency accumulated based on the purchase.

13. The gaming system of claim 11, wherein the amount of the automatic wager in the intermediate currency for the determined monetary value is discounted relative to a cash wager of a same monetary value.

14. The gaming system of claim 11, wherein the gaming system comprises an Electronic Gaming Machine (EGM).

15. A method for managing rewards associated with use of a credit account, the method comprising:

receiving, by a rewards management system, an electronic message indicating use of a credit account to make a purchase, the electronic message indicating a value of the purchase;

updating, by a rewards management system, an accumulated rewards value stored in an electronic record associated with a user, the user also associated with the credit account, wherein the accumulated rewards value stored in the electronic record associated with the user comprises a portion available for wagering and a portion unavailable for wagering, and wherein the portion unavailable for wagering is incremented based on the value of the purchase, wherein the accumulated rewards value stored in the electronic record associated with the user comprises an intermediate currency, and wherein updating the accumulated rewards value stored in the electronic record is based on a predefined ratio between the value of the purchase and the intermediate currency;

after passage of a predetermined amount of time, decrementing, by the rewards management system, the portion unavailable for wagering based on the value of the purchase and incrementing, by the rewards management system, the portion available for wagering based on the value of the purchase, wherein the predetermined amount of time is based on an amount of time during which the purchase can be reversed;

determining, by the rewards management system, an amount for an automatic wager for a gaming event based on the portion of the accumulated rewards value available for wagering;

providing, by the rewards management system, an electronic message indicating the determined amount of the automatic wager placed on the gaming event, wherein the electronic message initiates the automatic wager for the determined amount on the gaming system; and decrementing, by the rewards management system, the portion of the accumulated rewards value available for wagering based on the amount of the wager.

16. The method of claim 15, wherein the electronic message indicating the amount of the automatic wager on the gaming event is provided automatically based on a set of predefined parameters identifying the gaming event, the amount of the wager, and conditions for automatically providing the electronic message indicating the amount of the automatic wager.

17. The method of claim 15, wherein the electronic message indicating the amount of the automatic wager on the gaming event is provided in response to a request from the user identifying the gaming event and the amount of the automatic wager at a time when the portion of the accumulated rewards value available for wagering exceeds the identified amount of the automatic wager.

18. The method of claim 17, further comprising:

monitoring, by the rewards management system, the request from the user identifying the gaming event and the amount of the wager and a subsequent request from the user identifying the gaming event and the amount of the wager; and identifying, by the rewards management system, a pattern for wagers by the user based on the monitoring.

19. The method of claim 18 further comprising providing, by the rewards management system, a reminder to the user of a regularly placed wager based on the identified pattern.

20. The method of claim 18 further comprising providing, by the rewards management system, a suggestion for definition of an automatic wager based on the identified pattern.

* * * * *